US008831486B2

(12) United States Patent
Toichi

(10) Patent No.: US 8,831,486 B2
(45) Date of Patent: Sep. 9, 2014

(54) DEVELOPING DEVICE AND IMAGE FORMING APPARATUS PROVIDED WITH SAME

(75) Inventor: Tetsuya Toichi, Osaka (JP)

(73) Assignee: Kyocera Document Solutions Inc. (JP)

( * ) Notice: Subject to any disclaimer, the term of this patent is extended or adjusted under 35 U.S.C. 154(b) by 46 days.

(21) Appl. No.: 13/609,370

(22) Filed: Sep. 11, 2012

(65) Prior Publication Data

US 2013/0071145 A1 Mar. 21, 2013

(30) Foreign Application Priority Data

Sep. 15, 2011 (JP) ..... 2011-202075

(51) Int. Cl.
*G03G 15/09* (2006.01)
*G03G 15/08* (2006.01)

(52) U.S. Cl.
CPC ..... *G03G 15/0812* (2013.01); *G03G 15/09* (2013.01); *G03G 15/081* (2013.01)
USPC ..... 399/267

(58) Field of Classification Search
CPC ..... G03G 15/0121; G03G 15/0126; G03G 15/081; G03G 15/0812; G03G 15/0822; G03G 2215/085
See application file for complete search history.

(56) References Cited

U.S. PATENT DOCUMENTS 6,337,957 B1 * 1/2002 Tamaki et al. ..... 399/29
2009/0185831 A1 * 7/2009 Kotera et al. ..... 399/254

FOREIGN PATENT DOCUMENTS

JP 2002-174950 6/2002
JP 2007-322707 12/2007

* cited by examiner

*Primary Examiner* — Clayton E Laballe
*Assistant Examiner* — Victor Verbitsky
(74) *Attorney, Agent, or Firm* — Gerald E. Hespos; Michael J. Porco; Matthew T. Hespos

(57) ABSTRACT

A developing device includes a case for housing a developer, a magnetic roller, an agitating member, a layer thickness restricting member and a plurality of projection members. The magnetic roller is arranged in the case, includes a rotary shaft and magnetically carries the developer on a circumferential surface. The agitating member is arranged to face the magnetic roller in the case, includes a shaft center and a screw forming portion arranged around the shaft center. The layer thickness restricting member restricts the layer thickness of the developer to a predetermined thickness. The plurality of projection members are arranged along a rotation axis direction of the magnetic roller to face the circumferential surface of the magnetic roller at a side upstream of the layer thickness restricting member in a rotating direction of the magnetic roller and comes into contact with the developer carried on the magnetic roller.

11 Claims, 5 Drawing Sheets

DEVELOPING DEVICE AND IMAGE FORMING APPARATUS PROVIDED WITH SAME

INCORPORATION BY REFERENCE

This application is based on Japanese Patent Application Serial No. 2011-202075 filed with the Japan Patent Office on Sep. 15, 2011, the contents of which are hereby incorporated by reference.

BACKGROUND

The present disclosure relates to a developing device used in an image forming apparatus such as a printer and particularly to a developing device adopting a two-component developer containing a carrier and a toner and an image forming apparatus provided with the same.

Conventionally, a developing device as described below is known as a developing device used in an image forming apparatus such as a printer. Such a developing device includes a screw feeder (agitating member) for agitating a toner by rotating about a shaft center, a magnetic roller arranged in parallel to this screw feeder and configured to supply the toner fed from the screw feeder to the circumferential surface of a photoconductive drum by rotation about a shaft center and a layer thickness restricting member with a leading end edge part facing the circumferential surface of the magnetic roller and extending in an axial center direction of the magnetic roller, the screw feeder, the magnetic roller and the layer thickness restricting member being mounted in a development housing.

Here, by rotating the screw feeder about its shaft center, a developer loaded in a case is moved upward while being agitated, and compressed through a clearance between a compressing member arranged to face the screw feeder and the screw feeder (hereinafter, developer compressing clearance). Thereafter, this developer passes between the layer thickness restricting member and the magnetic roller and is supplied to the circumferential surface of the magnetic roller in a state set to a predetermined thickness. Since the developer is smoothly fed toward the layer thickness restricting member while being kept in a compressed state by the presence of this developer compressing clearance, there is no such inconvenience that the developer moves toward the layer thickness restricting member in an insufficiently compressed state.

The conventional technology is effective under such a condition that the amount of the developer in the development housing is relatively small and the developer separated from the magnetic roller and having fallen down is conveyed upward again after slipping under the screw feeder since the developer can pass through the developer compressing clearance. However, if the amount of the developer in the development housing is relatively large, a problem occurs. That is, if the developer is stored in the development housing to such a degree as to cover an area above the screw feeder, the developer separated from the magnetic roller and having fallen down cannot slip under the screw feeder after passing a developing portion in which the developer is supplied toward the photoconductive drum. Thus, the developer that has fallen, triggered by the operation of the screw feeder, may adhere to the magnetic roller again. Since a toner/carrier ratio differs between the fallen developer and the developer in the development housing, a toner density distribution is produced on the magnetic roller, with the result that the density of an image formed on a sheet may vary. In such a case, the separated developer cannot pass through the developer compressing clearance with the conventional technology, wherefore it is difficult to solve a variation of toner density on the magnetic roller.

The present disclosure was developed to solve the problem as described above and an object thereof is particularly to solve a variation of toner density on a magnetic roller of a developing device.

SUMMARY

A developing device according to one aspect of the present disclosure comprises a case for housing a developer, a magnetic roller an agitating member, a layer thickness restricting member and a plurality of projection members. The magnetic roller is arranged in the case, includes a rotary shaft and magnetically carries the developer on a circumferential surface by rotating about the rotary shaft. The agitating member is arranged to face the magnetic roller in the case, includes a shaft center and a screw forming portion arranged around the shaft center and agitates and conveys the developer while rotating. The layer thickness restricting member is arranged to face the magnetic roller and restricts the layer thickness of the developer supplied from the agitating member to the magnetic roller to a predetermined thickness. The plurality of projection members are arranged along a rotation axis direction of the magnetic roller to face the circumferential surface of the magnetic roller at a side upstream of the layer thickness restricting member in a rotating direction of the magnetic roller and comes into contact with the developer carried on the magnetic roller.

An image forming apparatus according to another aspect of the present disclosure comprises an image bearing member and the above developing device. An electrostatic latent image is formed on a surface of the image bearing member and developed into a developer image by a developer supplied from the magnetic roller.

These and other objects, features and advantages of the present disclosure will become more apparent upon reading the following detailed description along with the accompanying drawings.

DETAILED DESCRIPTION

Figure 1:
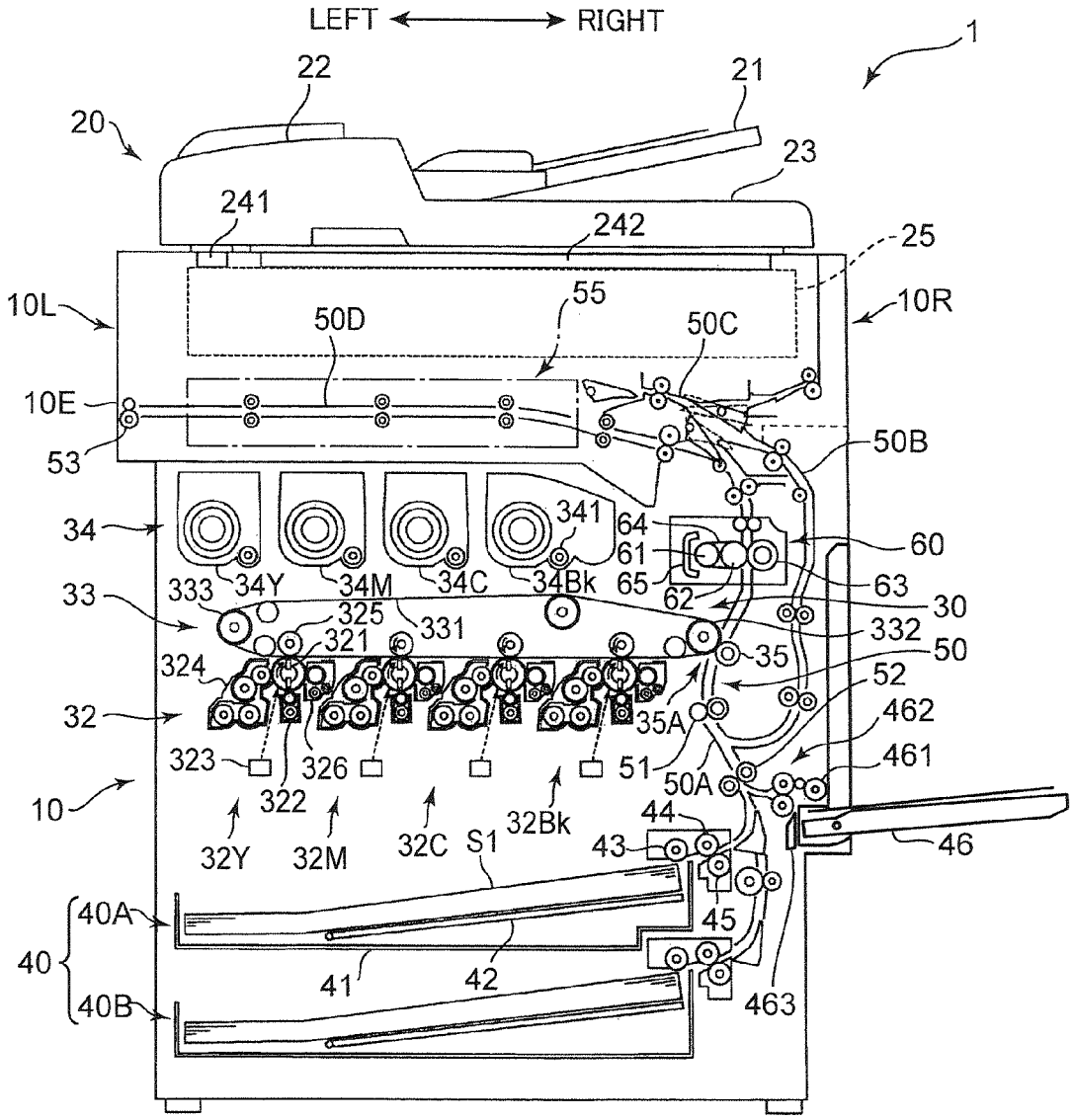
FIG. 1 is a sectional view showing the internal structure of an image forming apparatus according to one embodiment of the present disclosure.

Hereinafter, embodiments of the present disclosure are described based on the drawings. FIG. 1 is a sectional view showing the internal structure of an image forming apparatus 1 according to one embodiment of the present disclosure. Although a complex machine provided with a printer function and a copier function is illustrated as the image forming apparatus 1 here, the image forming apparatus may be a printer, a copier or a facsimile machine.

The image forming apparatus 1 includes an apparatus main body 10 having a substantially rectangular parallelepipedic case structure, an auto document feeder 20 arranged atop the apparatus main body 10 and a manual feed tray 46 attached to a lower part of a right side surface 10R of the apparatus main body 10. In the apparatus main body 10 are housed a reading unit 25 for optically reading a document image to be copied, an image forming station 30 for forming a toner image on a sheet, a fixing unit 60 for fixing the toner image to the sheet, a sheet feeding unit 40 for storing standard size sheets to be conveyed to the image forming station 30, a conveyance route 50 in which a standard size sheet is conveyed from the sheet feeding unit 40 or the manual feed tray 46 to a sheet discharge opening 10E via the image forming station 30 and the fixing unit 60, and a conveying unit 55 internally including a sheet conveyance path forming a part of this conveyance route 50.

The auto document feeder (ADF) 20 is rotatably mounted on the upper surface of the apparatus main body 10. The ADF 20 automatically feeds a document sheet to be copied to a predetermined document reading position (position where a first contact glass 241 is mounted) in the apparatus main body 10. On the other hand, when a user manually places a document sheet at a predetermined document reading position (position where a second contact glass 242 is mounted), the ADF 20 is opened upward. The ADF 20 includes a document tray 21 on which document sheets are to be placed, a document conveying unit 22 for conveying a document sheet via the automatic document reading position and a document discharge tray 23 to which the read document sheet is to be discharged.

The reading unit 25 optically reads an image of a document sheet via the first contact glass 241 for reading a document sheet automatically fed from the ADF 20 on the upper surface of the apparatus main body 10 or the second contact glass 242 for reading a manually placed document sheet. A scanning mechanism including a light source, a moving carriage, a reflecting mirror and the like and an imaging element are housed in the reading unit 25 (not shown). The scanning mechanism irradiates light to a document sheet and guides light reflected by the document sheet to the imaging element. The imaging element photoelectrically converts the reflected light into an analog electrical signal. The analog electrical signal is input to the image forming station 30 after being converted into a digital electrical signal in an A/D conversion circuit.

The image forming station 30 performs a process of generating a full-color toner image and transferring it to a sheet and includes an image forming unit 32 with four units 32Y, 32M, 32C and 32Bk arranged in a tandem manner for forming a toner image of each of yellow (Y), magenta (M), cyan (C) and black (Bk), an intermediate transfer unit 33 arranged above and adjacent to the image forming unit 32, and a toner supply unit 34 arranged above the intermediate transfer unit 33.

Each of the image forming units 32Y, 32M, 32C and 32Bk includes a photoconductive drum 321 (referred to as an image bearing member), and a charger 322, an exposure device 323, a developing device 324, a primary transfer roller 325 and a cleaning device 326 arranged around this photoconductive drum 321.

The photoconductive drum 321 is rotated about its shaft and an electrostatic latent image and a toner image are formed on the circumferential surface thereof. A photoconductive drum made of amorphous silicon (a-Si) material can be used as the photoconductive drum 321. The charger 322 uniformly charges the surface of the photoconductive drum 321. The exposure device 323 includes optical components such as a laser light source, a mirror and a lens and irradiates the circumferential surface of the photoconductive drum 321 with light based on image data of a document image, thereby forming an electrostatic latent image.

The developing device 324 supplies a toner to the circumferential surface of the photoconductive drum 321 to develop the electrostatic latent image formed on the photoconductive drum 321. The developing device 324 is for a two-component developer and includes screw feeders 85, 86, a magnetic roller 82 and a developing roller 83. This developing device 324 is described in detail later.

The primary transfer roller 325 forms a nip portion together with the photoconductive drum 321 with an intermediate transfer belt 331 of the intermediate transfer unit 33 sandwiched therebetween and primarily transfers a toner image on the photoconductive drum 321 to the intermediate transfer belt 331. The cleaning device 326 includes a cleaning roller and the like and cleans the circumferential surface of the photoconductive drum 321 after the transfer of the toner image.

The intermediate transfer unit 33 includes the intermediate transfer belt 331, a drive roller 332 and a driven roller 333. The intermediate transfer belt 331 is an endless belt mounted between the drive roller 332 and the drive roller 333 and toner images from a plurality of photoconductive drums 321 are transferred in a superimposition manner at the same position on the outer circumferential surface of the intermediate transfer belt 331 (primary transfer).

A secondary transfer roller 35 is arranged to face the circumferential surface of the drive roller 332. A nip portion between the drive roller 332 and the secondary transfer roller 35 serves a secondary transfer portion 35A for transferring a full-color toner image formed by the toner images transferred in a superimposition manner to the intermediate transfer belt 331 to a sheet. A secondary transfer bias having a polarity opposite to that of the toner image is applied to either one of the drive roller 332 and the secondary transfer roller 35, whereas the other roller is grounded.

The toner supply unit 34 includes a yellow toner container 34Y, a magenta toner container 34M, a cyan toner container 34C and a black toner container 34Bk. These toner containers 34Y, 34C, 34M and 34Bk are respectively for storing toners of the respective colors and supply the toners of the respective colors to the developing devices 321 of the image forming units 32Y, 32M, 32C and 32Bk corresponding to the respective YMCBk colors via unillustrated supply paths. Each of the toner containers 34Y, 34C, 34M and 34Bk includes a conveying screw 341 for conveying the toner in the container to an unillustrated toner discharge opening. This conveying screw 341 is driven and rotated by a driver (not shown), whereby the toner is supplied into the developing device 324.

The sheet feeding unit 40 includes sheet cassettes 40A, 40B arranged in two levels for storing sheets S1 out of sheets to which an image forming process can be applied. These sheet cassettes 40A, 40B can be pulled out forward from the front side of the apparatus main body 10.

The sheet cassette 40A (40B) includes a sheet storing portion 41 for storing a sheet stack formed by stacking the sheets S1 one over another and a lift plate 42 for lifting up the sheet stack for sheet feeding. A pickup roller 43 and a roller pair composed of a feed roller 44 and a retard roller 45 are arranged above the right end of the sheet cassette 40A (40B). By driving the pickup roller 43 and the feed roller 44, the uppermost sheet S1 of the sheet stack in the sheet cassette 40A is fed one by one and conveyed into an upstream end of the conveyance route 50.

The manual feed tray 46 is provided at the right side surface 10R of the apparatus main body 10. The manual feed tray 46 is attached to the apparatus main body 10 openably and closably about a lower end part thereof. The user opens the manual feed tray 46 as shown and places a sheet thereon in the case of manually feeding. The sheet placed on the manual feed tray 46 is conveyed into the conveyance route 50 by driving a pickup roller 461 and a feed roller 462.

The conveyance route 50 includes a main conveyance path 50A for conveying a sheet from the sheet feeding unit 40 to the exit of the fixing unit 60 via the image forming station 30, a reversing conveyance path 50B for returning a sheet having one side printed to the image forming station 30 in the case of printing both sides of the sheet, a switchback conveyance path 50C for conveying a sheet from a downstream end of the main conveyance path 50A to an upstream end of the reversing conveyance path 50B, and a horizontal conveyance path 50D for horizontally conveying a sheet from the downstream end of the main conveyance path 50A to the sheet discharge opening 10E provided in a left side surface 10L of the apparatus main body 10. This horizontal conveyance path 50D is mostly formed by the sheet conveyance path provided in the conveying unit 55.

The fixing unit 60 is an induction heating type fixing device for applying a fixing process of fixing a toner image to a sheet and includes a heating roller 61, a fixing roller 62, a pressure roller 63, a fixing belt 64 and an induction heating unit 65. The pressure roller 63 is pressed into contact with the fixing roller 62 to form a fixing nip portion. The heating roller 61 and the fixing belt 64 are induction-heated by the induction heating unit 65 to give that heat to the fixing nip portion. A sheet passes through the fixing nip portion, whereby a toner image transferred to the sheet is fixed to the sheet.

<Detailed Configuration of Developing Device>

Figure 2:
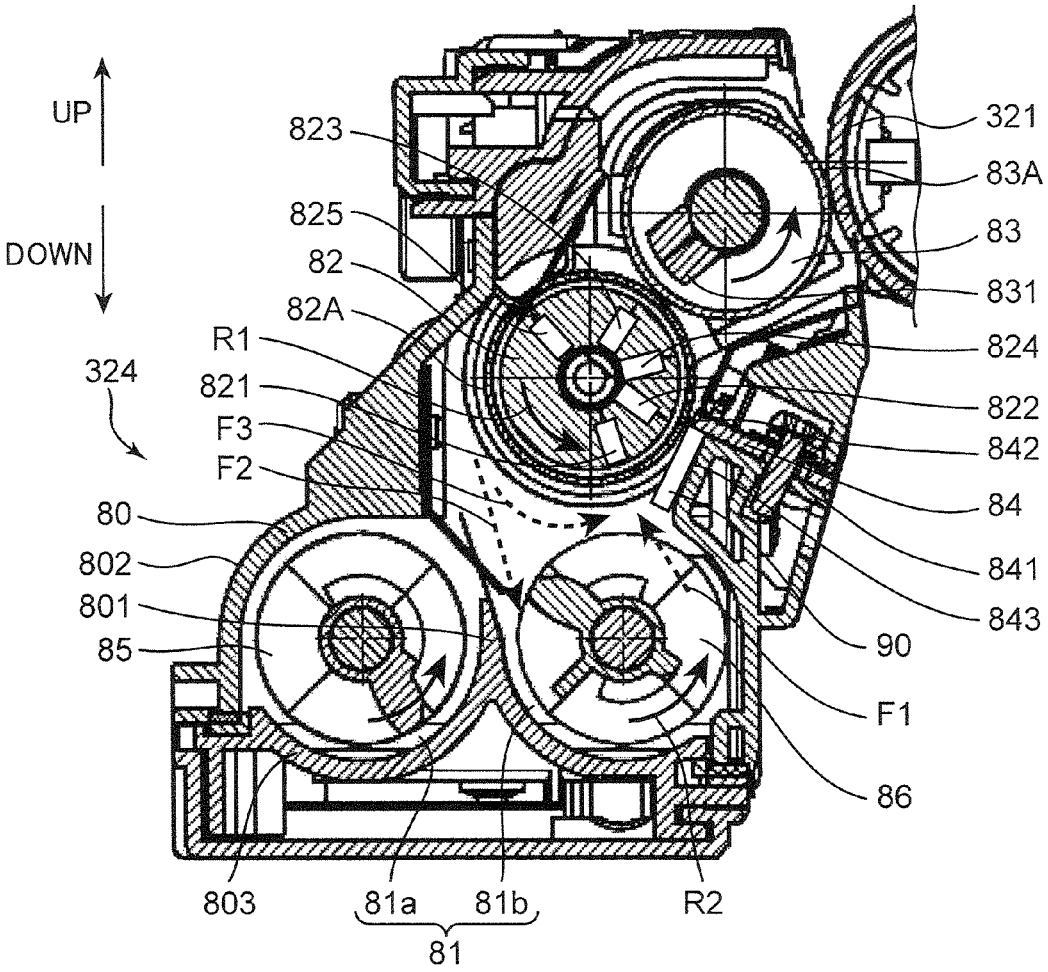
FIG. 2 is a sectional view of a developing device according to the one embodiment of the present disclosure.

Next, the developing device 324 of this embodiment is described in detail. FIG. 2 is a vertical sectional view schematically showing the internal structure of the developing device 324. The developing device 324 includes a development housing 80 (referred to as a case) defining the internal space of the developing device 324. The development housing 80 includes a lid portion 802 for covering respective rollers housed therein from above and a bottom portion 803 connected to the lid portion 802 and forming a lower surface part of the development housing 80.

This development housing 80 includes a developer storing portion 81 which is a cavity for storing a developer containing a nonmagnetic toner and a magnetic carrier and can convey the developer while agitating it. In the development housing 80 are housed the magnetic roller 82 (referred to as a developer bearing member) arranged in an upper part of the developer storing portion 81, the developing roller 83 (referred to as a toner bearing member) arranged to face the magnetic roller 82 at a position obliquely upward from the magnetic roller 82, a developer restricting blade 84 (referred to as a layer thickness restricting member) arranged to face the magnetic roller 82 and the screw feeders 85, 86 for agitating and conveying the developer.

The developer storing portion 81 includes two adjacent developer storage chambers 81*a*, 81*b* extending in a longitudinal direction of the developing device 324. Although the developer storage chambers 81*a*, 81*b* are partitioned from each other by a partition plate 801 integrally formed to the bottom portion 803 of the development housing 80 and extending in the longitudinal direction, they communicate with each other via communication paths 804, 805 at both ends in the longitudinal direction (see FIG. 3). The screw feeders 85, 86 (referred to as an agitating member) are respectively housed in the developer storage chambers 81*a*, 81*b* and agitate and convey the developer by rotating about their shafts. The screw feeder 86 is arranged to face the magnetic roller 82 in the development housing 80, includes a shaft center 862 and a screw forming portion arranged around the shaft center 862, and agitates and conveys the developer while rotating. An outer rim 861 of the screw forming portion has a spiral shape arranged around the shaft center 862. The screw feeders 85, 86 are driven and rotated by an unillustrated driving mechanism and developer conveying directions thereof are set to be opposite to each other along an axial direction. This causes the developer to be conveyed in a circulating manner while being agitated between the developer storage chambers 81*a*, 81*b* as shown by arrows D1, D2 in FIG. 3. By this agitation, the toner and the carrier are mixed, whereby the toner is, for example, negatively charged.

The magnetic roller 82 is arranged along the longitudinal direction of the developing device 324 and rotatable in a counterclockwise direction in FIG. 2. A fixed so-called magnet roll is arranged in the magnetic roller 82. The magnet roll has a plurality of magnetic poles and, in this embodiment, includes a pumping pole 821, a restricting pole 822, a main pole 823 and further a conveying pole 824 and a separating pole 825. The pumping pole 821 is facing the developer storing portion 81, the restricting pole 822 is facing the developer restricting blade 84 and the main pole 823 is facing the developing roller 83. Further, the conveying pole 824 is arranged between the restricting pole 822 and the main pole 823 and the separating pole 825 is arranged downstream of the main pole 823 in the rotating direction of the magnetic roller 82.

The magnetic roller 82 magnetically pumps up (receives) the developer from the developer storage chamber 81*b* onto a circumferential surface 82A thereof by a magnetic force of the pumping pole 821 as shown by an arrow F1 of FIG. 2. The pumped-up developer is magnetically held as a developer layer (magnetic brush layer) on the circumferential surface 82A of the magnetic roller 82 and conveyed toward the developer restricting blade 84 according to the rotation of the magnetic roller 82.

The developer restricting blade 84 is arranged upstream of the developing roller 83 in the rotating direction of the magnetic roller 82 and restricts the layer thickness of the developer layer magnetically adhering to the circumferential surface 82A of the magnetic roller 82. The developer restricting blade 84 is a plate member made of a magnetic material and extending along the longitudinal direction of the magnetic roller 82 and is supported by a predetermined supporting member 841 fixed at an appropriate position of the development housing 80. The supporting member 841 is in the shape of a rectangular column having a substantially trapezoidal cross-sectional shape and extending in a rotation axis direction of the magnetic roller 82. The supporting member 841 has a facing surface 843 which is one surface extending in its longitudinal direction, intersecting with the developer restricting blade 84 and facing the magnetic roller 82. Further, the developer restricting blade 84 has a restricting surface 842 (i.e. leading end surface of the developer restricting blade 84) which forms a restriction gap of a predetermined dimension between itself and the circumferential surface 82A of the magnetic roller 82.

Figures 4A, 4B:
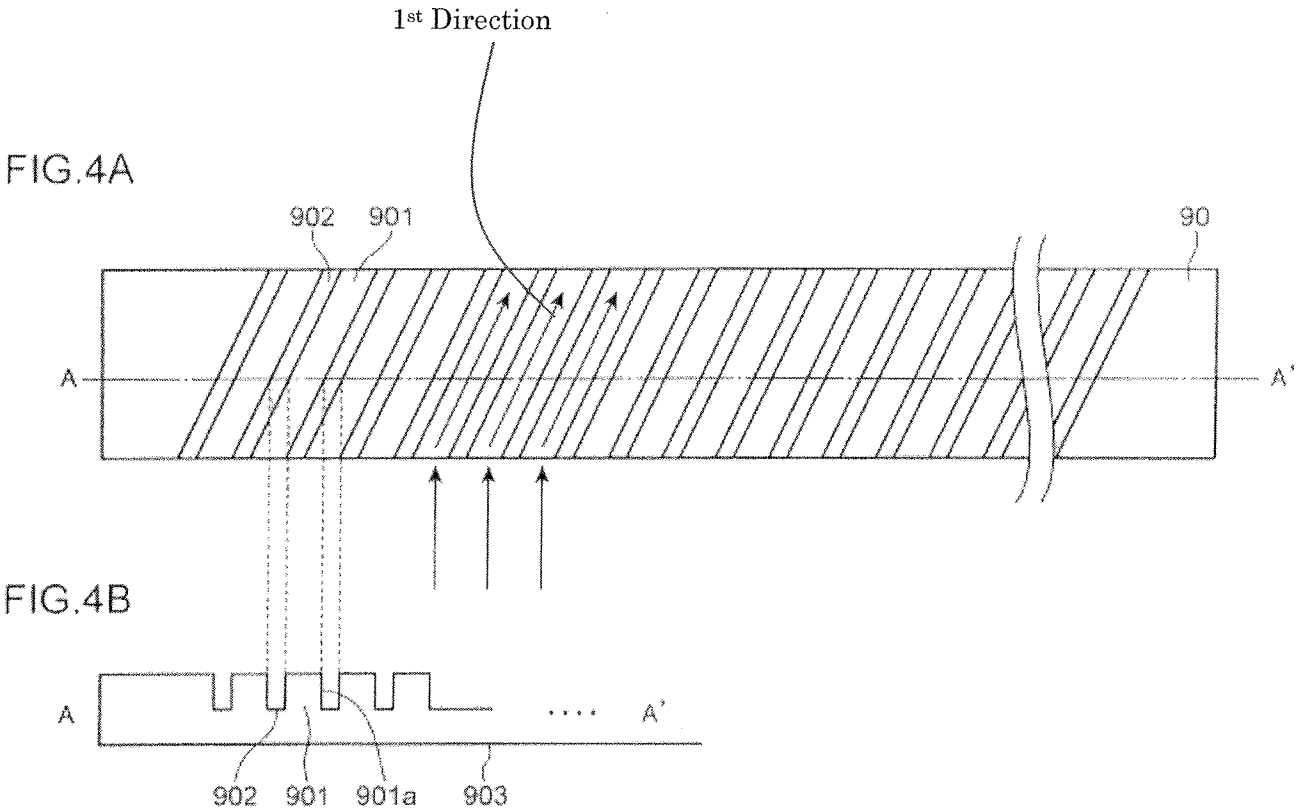

Here, in this embodiment, a restricting plate 90 arranged to face the rotational circumferential surface of the magnetic roller 82 while being spaced apart by a predetermined distance is arranged upstream of the developer restricting blade 84 in the rotating direction of the magnetic roller 82. The restricting plate 90 is a plate-like member made of a resin material and adhesively fixed to the facing surface 843 of the supporting member 841, and the upper end edge thereof is in contact with the developer restricting blade 84. The restricting plate 90 has a length extending over the entire length of the magnetic roller 82 in the rotation axis direction. Further, a plurality of elongated projections 901 (referred to as projection members) extending at a predetermined angle toward the developer restricting blade 84 are arranged on a surface of the restricting plate 90 facing the magnetic roller 82 (FIGS. 4A, 4B). The plurality of elongated projections 901 are arranged adjacent to each other along the rotation axis direction of the magnetic roller 82, and groove portions 902 of a predetermined width are formed between adjacent elongated projections.

The developer layer adhering to the circumferential surface 82A of the magnetic roller 82 by the pumping pole 821 is conveyed toward the developer restricting blade 84 while being held in contact with the restricting plate 90. Note that behaviors of the developer in the restricting plate 90 are described in detail later.

The developer restricting blade 84 made of the magnetic material is magnetized by the restricting pole 822 of the magnetic roller 82. This causes a magnetic path to be formed between the restricting surface 842 of the developer restricting blade 84 and the restricting pole 822, i.e. in the restriction gap. When the developer is conveyed into the restriction gap from between the restricting plate 90 and the magnetic roller 82 according to the rotation of the magnetic roller 82, the layer thickness of the developer layer is restricted in the restriction gap. This causes a uniform developer layer having a predetermined thickness to be formed on the circumferential surface 82A.

The developing roller 83 is arranged to extend along the longitudinal direction of the developing device 324 and in parallel to the magnetic roller 82 and is rotatable in a counterclockwise direction in FIG. 2. The developing roller 83 has a circumferential surface 83A which receives the toner from the developer layer and carries a toner layer while rotating in contact with the developer layer held on the circumferential surface 82A of the magnetic roller 82. In the developing roller 83, a facing main pole 831 is arranged at a position facing the main pole 823 of the magnetic roller 82. The toner moves from the developer layer on the circumferential surface 82A to the circumferential surface 83A since a magnetic field is formed between the main pole 823 and the facing main pole 831 and a predetermined voltage is set between the circumferential surface 82A and the circumferential surface 83A (developing portion). At the time of development in which a developing operation is performed, the toner on the circumferential surface 83A is supplied to the circumferential surface of the photoconductive drum 321. The developer on the magnetic roller 82 having passed through a facing portion facing the developing roller 83 is separated from the circumferential surface 82A by the separating pole 825, falls down to the developer storage chamber 81*b* located below in which the screw feeder 86 is housed, and is agitated again.

Note that the developing roller 83 and the magnetic roller 82 are driven and rotated by a drive source (not shown). A clearance of a predetermined dimension is formed between the circumferential surface 83A of the developing roller 83 and the circumferential surface 82A of the magnetic roller 82. The clearance is, for example, set at about 130 m. The developing roller 83 is arranged to face the photoconductive drum 321 through an opening formed in the development housing 80, and a clearance of a predetermined dimension is also formed between the circumferential surface 83A and the circumferential surface of the photoconductive drum 321.

<Concerning Cause for Toner Density Distribution>

Figure 3:
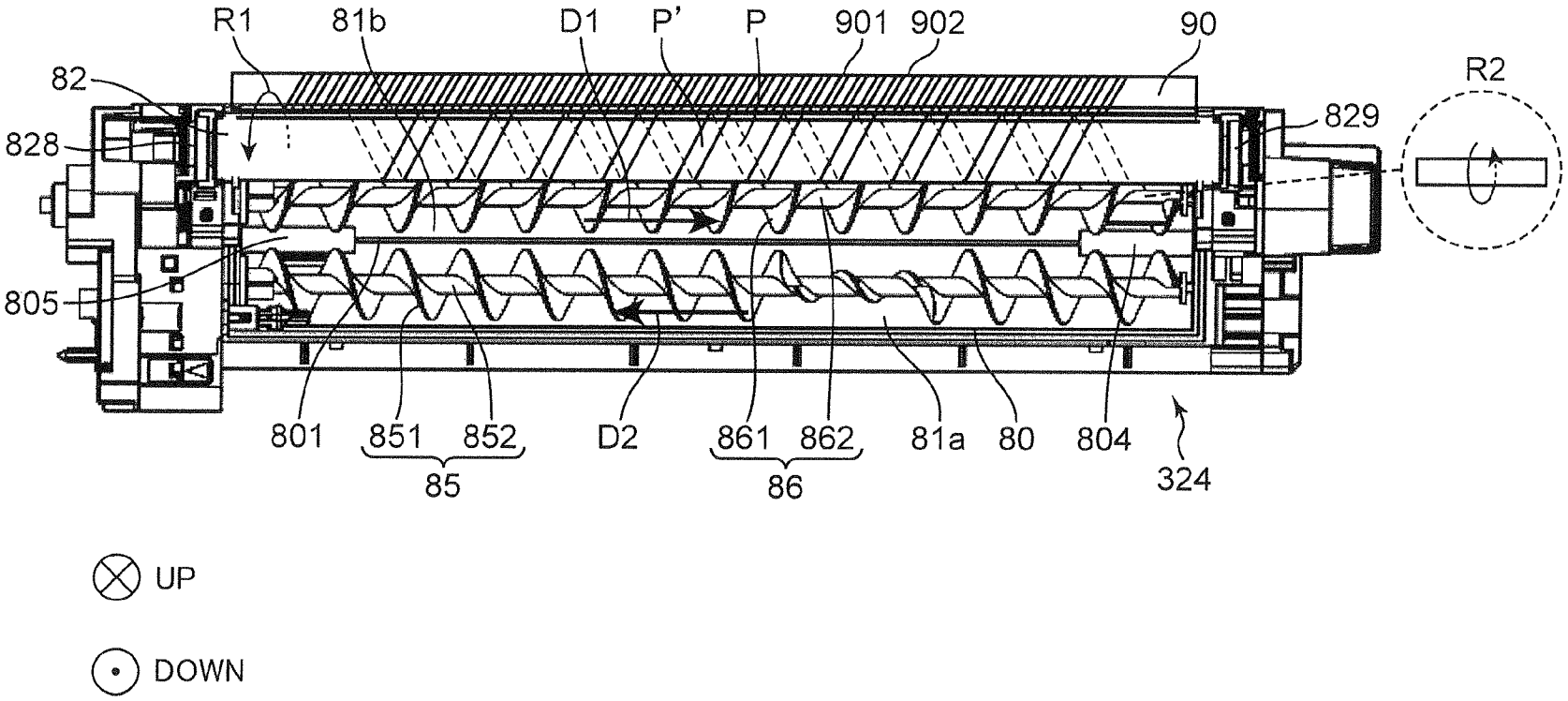
FIG. 3 is a view showing the internal structure of the developing device according to the one embodiment of the present disclosure, FIG. 4 are diagrams showing the structure of projection members according to a first embodiment of the present disclosure, and FIG. 5 are diagrams showing the structure of projection members according to a second embodiment of the present disclosure.

Next, a phenomenon in the developing device which occurs when the restricting plate 90 according to this embodiment is not provided is described with reference to FIGS. 2 and 3. FIG. 3 is a view showing the internal structure of the developing device 324 over the entire length in the longitudinal direction of the magnetic roller 82 from above. FIG. 3 shows a state where the lid portion 802 of the development housing 80 shown in FIG. 2 is removed and the screw feeder 86 is seen between the magnetic roller 82 and the screw feeder 85. Note that the developing roller 83 is not shown in FIG. 3.

In the development housing 80, the screw feeders 85, 86 substantially horizontally adjacent to each other convey the developer in opposite directions along the rotation axis direction of the magnetic roller 82 (arrows D1, D2 of FIG. 3). Further, developer conveying paths at ends of these screw feeders 85, 86 in the axial direction are allowed to communicate by the communication paths 804, 805 provided in the bottom portion 803 of the development housing 80, whereby a clockwise developer circulation path is formed as a whole.

The magnetic roller 82 is arranged to face the screw feeder 86 from above (first facing portion). The magnetic roller 82 rotates in a direction R1 in FIGS. 2 and 3 and the screw feeder 86 rotates in an opposite direction (direction R2) to the magnetic roller 82 in the first facing portion. A part of the developer from the screw feeder 86 is supplied to the circumferential surface 82A of the magnetic roller 82 (arrow F1 of FIG. 2) and the remaining developer is conveyed and agitated in the axial direction (arrow D1 of FIG. 3). Further, after the movement of the toner to the developing roller 83, the developer separated from the circumferential surface 82A by the separating pole 825 (FIG. 2) of the magnetic roller 82 flows into the conveyance path of the screw feeder 86 again (arrow F2 of FIG. 2).

Here, since a part of the toner is consumed by the developing roller 83 at the main pole 823 in accordance with an electrostatic latent image formed on the photoconductive drum 321, the above developer separated from the magnetic roller 82 and flowing to the screw feeder 86 again has a reduced ratio (T/C) of the toner to the carrier constituting the two-component developer. Accordingly, the developer separated from the magnetic roller 82 and the developer agitated and conveyed in the direction of the arrow D1 in the screw feeder 86 have different toner/carrier ratios (T/C).

However, if the amount of the developer in the developing device 324 is small, the separated developer falls down below the screw feeder 86 as shown by the arrow F2 of FIG. 2. Thereafter, this developer is sufficiently agitated together with the surrounding developer and then supplied to the magnetic roller 82 again after being conveyed to sink toward the bottom portion 803 of the development housing 80. Thus, partial non-uniformity of the toner/carrier ratio is unlikely to be problematic.

On the other hand, if the amount of the developer in the developing device 324 is large (e.g. 400 g) under use conditions of the developing device 324, this developer separated from the magnetic roller 82 (separated developer) cannot slip under the screw feeder 86 by a rotational force of the screw outer rim 861 (outer peripheral part of the spiral shape) of the screw feeder 86. Rather, this developer is pushed back upward and tends to adhere to the magnetic roller 82 again (arrow F3 of FIG. 2). Note that such a phenomenon becomes notable when the amount of the developer in the developer storing portion 81 largely varies in a mode of supplying not only the toner, but also the carrier depending on the use of the developing device, i.e. in a so-called trickle development mode.

The above re-adhering phenomenon of the separated developer to the magnetic roller 82 is attributable to the screw feeder 86. Parts where the re-adherence of the separated developer is notable are cyclically distributed on the magnetic roller 82 in conformity with the shape (spiral shape) of the screw outer rim 861 of the screw feeder 86. The cyclic distribution approximates to a line formed by projecting a trace of the screw outer rim 861 when the screw feeder 86 rotates on the facing surface (circumferential surface of the magnetic roller 82). As a result, the toner density is non-uniformly distributed on the magnetic roller 82.

In FIG. 3, dotted line parts P shown on the circumferential surface of the magnetic roller 82 represent a distribution of the re-adherence of the separated developer on the underside of the magnetic roller 82 (side facing the screw feeder 86), and the cycle and distribution shape thereof correspond to the shape of the screw outer rim 861 (spiral shape) of the facing screw feeder 86. That is, since the re-adherence of the separated developer is notable at positions of the circumferential surface 82A of the magnetic roller 82 facing the screw outer rim 861, the developer having a low T/C (toner density) is adhering. On the other hand, since a conveying force in a radial direction is small at positions corresponding to the shaft center 862 of the screw feeder 86, the separated developer is unlikely to re-adhere to the magnetic roller 82. Thus, the developer having slipped under the screw feeder 86, sufficiently agitated and having a high T/C is adhering to the circumferential surface 82A of the magnetic roller 82 (F1 of FIG. 2).

As just described, a distribution of the re-adhering developer corresponds to the projected shape of the trace of the screw outer rim 861 on the screw feeder 86 when the magnetic roller 82 and the screw feeder 86 rotate relative to each other on the circumferential surface of the magnetic roller 82. Note that solid line parts P' in FIG. 3 show a distribution when this re-adhering developer is conveyed toward the upper side of the circumferential surface 82A of the magnetic roller 82 according to the rotation of the magnetic roller 82.

Further, the developers having different T/C (toner densities) may have different fluidities. Accordingly, the above re-adhering developer distributed on the magnetic roller 82 and the surrounding developer supplied from below the screw feeder 86 may cause unevenness in the amount of the developer adhering to the circumferential surface 82A of the magnetic roller 82 (height difference of the developer layer on the circumferential surface 82A).

Such a variation of the T/C (toner density) and unevenness in the amount of the developer on the magnetic roller remain on the developing roller 83 to which the toner moves from the magnetic roller 82 and in a toner image on the photoconductive drum 321, which results in an image defect.

<Concerning Restricting Plate>

Here, in this embodiment, the restricting plate 90 is arranged at a position below the magnetic roller 82 and facing the outer circumferential surface of the magnetic roller 82 to solve the problem of the re-adherence of the separated developer (re-adhering developer). Note that, in FIG. 3, the restricting plate 90 is shown to be displaced upward for the explanation of an inclined relationship to be described later. In an actual positional relationship, the restricting plate 90 is located below and upstream of the developer restricting blade 84 in the rotating direction of the magnetic roller 82 as shown in FIG. 2.

FIG. 4A is an enlarged view of the restricting plate 90 according to this embodiment showing the surface facing the circumferential surface 82A of the magnetic roller 82. The restricting plate 90 is formed of a plate-like resin member having a predetermined thickness, and the elongated projections 901 (referred to as projection members) convexly projecting from a base portion 903 and the groove portions 902 in the form of recesses (grooves) arranged between the elongated projections 901 are arranged on the surface facing the magnetic roller 82 as shown in FIG. 4B (sectional view along A-A' of FIG. 4A). These elongated projections 901 are inclined at a predetermined angle to a line perpendicular to an axis of rotation of the magnetic roller 82 (line perpendicular to A-A' line of FIG. 4A) in such a direction that the upper ends are located more toward the right end of the restricting plate 90 (referred to as a first direction).

The restricting plate 90 is so arranged that a plurality of elongated projections 901 facing the circumferential surface 82A of the magnetic roller 82 and adjacent to each other come into contact with the developer layer on the magnetic roller 82. The developer in contact with the elongated projections 901 of the restricting plate 90 enters the groove portions 902, are guided to guiding walls 901*a* and conveyed in a direction inclined to the right as shown by arrows of FIG. 4A. Here, as shown in FIG. 3, a direction in which the elongated projections 901 are inclined is set to be opposite to the inclination (dotted line parts P) of the distribution of the re-adhering developer on the circumferential surface of the magnetic roller 82. That is, the inclination (referred to as a first inclined shape) of the projected shape of the trace of the screw outer rim 861 of the screw feeder 86 on the circumferential surface of the magnetic roller 82 when the magnetic roller 82 and the screw feeder 86 rotate relative to each other and the inclination (referred to as a second inclined shape) of projected shapes of the inclined elongated projections 901 on the circumferential surface of the magnetic roller 82 intersect. More specifically, the projected shape of the screw outer rim 861 of the screw feeder 86 on the circumferential surface of the magnetic roller 82 when the magnetic roller 82 and the screw feeder 86 rotate relative to each other is inclined toward one end 828 of the rotary shaft of the magnetic roller 82 along the rotation axis direction of the magnetic roller 82. On the other hand, the projected shape of the inclined elongated projections 901 on the circumferential surface of the magnetic roller 82 is inclined toward another end 829 of the rotary shaft of the magnetic roller 82.

Thus, the re-adhering developer cyclically distributed on the magnetic roller 82 is agitated together with the surrounding developer and moves in a direction (direction intersecting with the dotted line parts P) away from areas (dotted line parts P of FIG. 3) where it has been distributed by being held in contact with the elongated projections 901. Thus, the developers having different toner densities and eccentrically located on the magnetic roller 82 are mixed to make the toner density uniform.

Further, even if there is unevenness in the amount of the developer (height difference) on the circumferential surface 82A of the magnetic roller 82, such unevenness is mitigated by the movement of the developer caused by the elongated projections 901.

Note that, in this embodiment, an interval between the adjacent elongated projections 901 is set to be smaller than an interval between adjacent sections of the screw outer rim 861 of the screw feeder 86 to be projected on the magnetic roller 82. In this case, the plurality of elongated projections 901 successively come into contact with the developer area (dotted line part P of FIG. 3) corresponding to the section of the screw outer rim 861 at one position on the magnetic roller 82, wherefore the movement of the developer in finer areas and the uniformity of the toner density are realized.

Here, in this embodiment, the magnetic roller 82 and the screw feeder 86 rotate in opposite directions in their facing portions, the direction of the inclination of the elongated projections 901 with respect to the rotation axis direction of the magnetic roller 82 is the same as the conveying direction D1 of the developer with respect to rotation axis direction of the screw feeder 86. That is, both are set to extend toward the other end 829 of the rotary shaft of the magnetic roller 82. Thus, the magnetic roller 82 and the screw feeder 86 rotate in the opposite directions in their facing portions, and the developer on the magnetic roller 82 having a variation of the toner density in conformity with the shape of the screw outer rim 861 of the screw feeder 86 can be moved in the same direction as the direction in which the developer is conveyed by the screw outer rim 861 with respect to the rotation axis direction of the screw feeder 86. Thus, the developer on the magnetic roller 82 can be agitated and a variation of the toner density can be more suppressed.

As described above, according to the restricting plate 90 of this embodiment, it is possible to reduce the cyclic distribution (toner density distribution) of the re-adhering developer caused by the re-adherence of the developer having passed through the main pole 823 of the magnetic roller 82 to the magnetic roller 82 due to the rotational force of the screw feeder after being separated from the magnetic roller 82 when the amount of the developer in the developing device 324 is large (e.g. 400 g). Further, an image defect caused by this cyclical distribution of the re-adhering developer can be effectively suppressed.

Further, the image forming apparatus 1 according to this embodiment includes the photoconductive drum 321 on the surface of which an electrostatic latent image is to be formed, and the developing device 324 described above. An electrostatic latent image on the photoconductive drum 321 is visualized by the toner supplied from the developing device 324. According to this configuration, when the amount of the developer in the developing device 324 is large, it is possible to suppress a variation of the toner density on the magnetic roller 82 in conformity with the screw shape of the screw feeder 86 and reduce the unevenness of image density on the photoconductive drum 321 caused by such a variation.

Although the developing device and the image forming apparatus according to the embodiment of the present disclosure have been described above, the present disclosure is not limited to this and, for example, the following modifications may be adopted.

(1) Although the plate-like member made of the resin material is used as the restricting plate 90 in the above embodiment, the restricting plate 90 is not limited to this and may be made of a metallic material. In this case, a nonmagnetic metallic material is preferably selected for the restricting plate 90 so that no magnetic field is formed between the restricting plate 90 and the magnetic poles included in the magnetic roller 82.

(2) Although the restricting plate 90 including the inclined elongated projections 901 as an embodiment of the projection members is described in the above embodiment, the projection members are not limited to this shape and only has to have an effect of effectively agitating the re-adhering developer on the magnetic roller 82 and disturbing the cyclic distribution of the re-adhering developer.

Figures 5A, 5B:
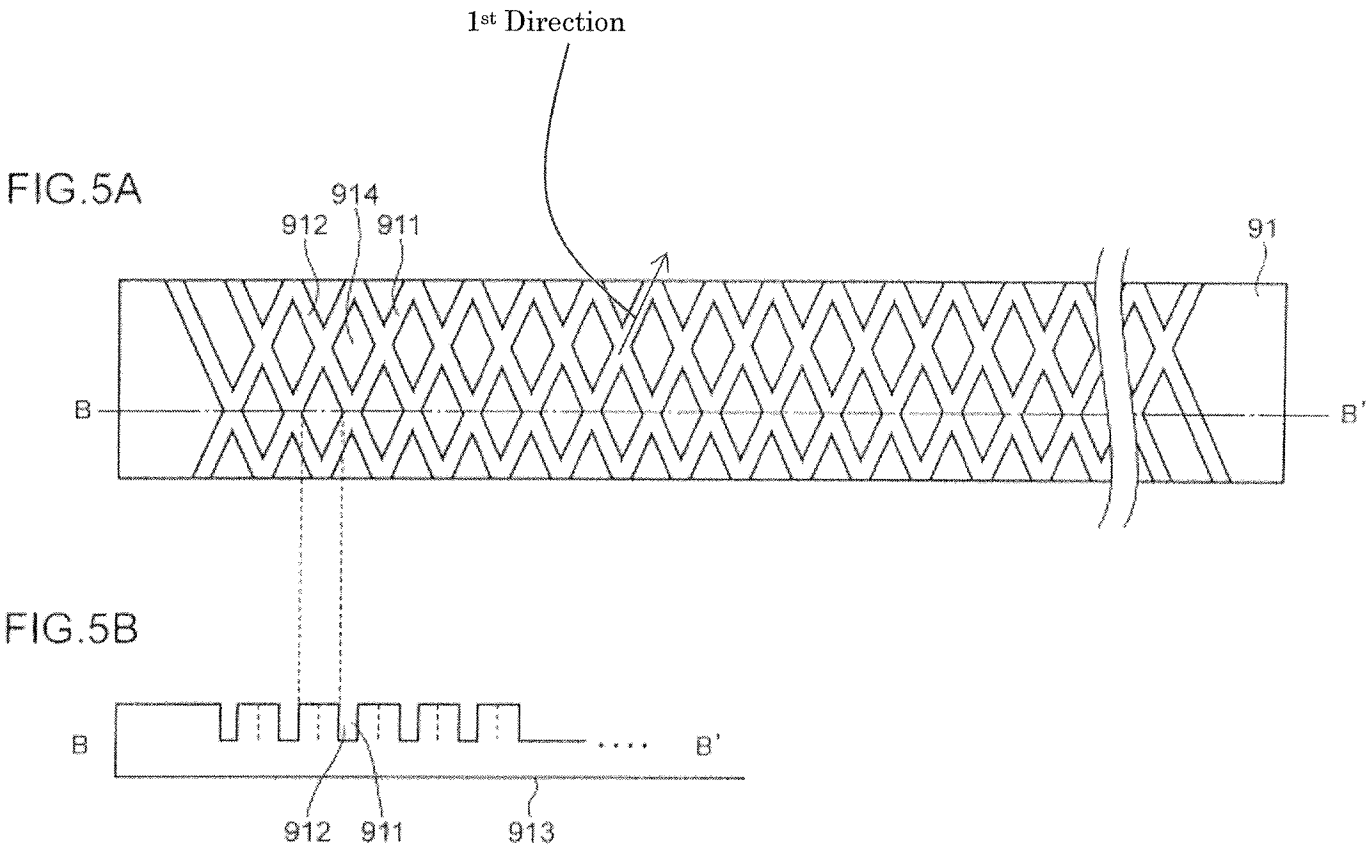

For example, FIGS. 5A and 5B are views showing a restricting plate 91 according to a second embodiment of the present disclosure. In the restricting plate 91, to form projection shapes, a base portion 913 is formed with a plurality of first grooves 911 (referred to as first groove portions) inclined such that the upper ends thereof are shifted to the right (referred to as a second direction) and a plurality of second grooves 912 (referred to as second groove portions) inclined such that the upper ends thereof are shifted to the left (referred to as a third direction), the first and second grooves 911, 912 extending in directions intersecting with each other. Rhombic projection portions 914 are formed between the first grooves 911 and the second grooves 912. When the projection portions 914 come into contact with a developer on the magnetic roller 82, the developer flows into the first and second grooves 911, 912. Here, since the first and second grooves 911, 912 intersect with each other, the developer flowing into these grooves is agitated while being repeatedly split and colliding. Thus, the aforementioned variation of the toner density is effectively solved. Note that an interval between the first grooves 911 or the second grooves 912 is preferably set to be smaller than an interval (pitch) between the sections of the screw outer rim 861 of the screw feeder 86 projected on the magnetic roller 82. In this case, the movement of the developer is realized in finer areas and the unevenness (height difference) of the amount of the developer on the magnetic roller 82 can be made more uniform. Note that since the other configurations and arrangement relationships are the same as in the first embodiment, detailed description is not made.

EXAMPLES

Examples in which the distribution of the re-adhering developer on the magnetic roller 82 was mitigated by the restricting plate 90 and 91 according to the above embodiments and screw unevenness was effectively improved in print image quality are described next.

Note that imaging was performed under the following data and conditions in Examples and Comparative Examples.

<Apparatus Conditions>

Image forming apparatus: TASKalfa 5550ci produced by Kyocera Mita

Photoconductive drum: diameter ϕ of 30 mm, circumferential speed of 300 mm/sec, surface potential (dark potential) of 300 V, light potential of 10 V Rotary sleeve of developing roller: made of aluminum, diameter ϕ of 20 mm, circumferential speed of 450 mm/sec Rotary sleeve of magnetic roller: made of aluminum, diameter ϕ of 20 mm, circumferential speed of 675 mm/sec Toner average particle diameter: 6.8 μm Carrier average particle diameter: 35 μm Toner/carrier weight ratio: 11%

Shortest distance between the surfaces of the magnetic roller 82 and the developing roller 83: 350 μm Shortest distance between the surfaces of the developing roller 83 and the photoconductive drum 321: 150 μm Developing roller applied voltages: Vdc2=300 V, Vpp=1.6 kV, frequency f=2.7 kHz, duty ratio=50%

Magnetic roller applied voltages: Vdc1=400 V, Vpp having the same cycle as, but an opposite phase to the developing roller applied voltage Vpp=2.8 kV, frequency f=2.7 kHz, duty ratio=70%

<Restricting Plate>

Example 1

Includes the restricting plate 90 according to the first embodiment

Width of the groove portions 902: 1 mm

Depth of the groove portions 902: 1.5 mm

Interval of the groove portions 902: 3 mm (Width and interval of the groove portions 902 were both measured on a straight line orthogonal to the direction of inclination of the groove portions 902).

Example 2

Includes the restricting plate 91 according to the second embodiment

Widths of the first and second grooves 911, 912: 1 mm

Depths of the first and second grooves 911, 912: 1.5 mm

Intervals of the first and second grooves 911, 912: 3 mm (Widths and intervals of the above grooves were both measured on a straight line orthogonal to the directions of inclination of the grooves).

Comparative Example 1

Includes no restricting plate

Comparative Example 2

Includes no restricting plate, but includes the compressing member disclosed in Japanese Unexamined Patent Publication No. 2007-322707

Table 1 shows an evaluation result of screw unevenness obtained by visually evaluating unevenness appearing due to the screw shape of the screw feeder 86 (screw unevenness) in forming a high-density image on the entire surface of an A3 print. ○ indicates no appearance of screw unevenness, Δ indicates partial unevenness appearing on end parts of the magnetic roller 82 in the axial direction since the amount of the developer slightly varies among the groove portions of the restricting plate 90 when the amount of the developer on the magnetic roller 82 is small, and x indicates notable appearance of screw unevenness. In any one of these, whether or not unevenness appeared was evaluated while the amount of the developer in the developing device 324 is changed.

TABLE 1

| Amount of Developer (g) | Example 1 | Example 2 | Comparative Example 1 | Comparative Example 2 |
|---|---|---|---|---|
| 300 | Δ | ○ | x | ○ |
| 325 | ○ | ○ | ○ | ○ |
| 350 | ○ | ○ | ○ | ○ |
| 375 | ○ | ○ | x | x |
| 400 | ○ | ○ | x | x |

As shown in Table 1, in Examples 1 and 2, screw unevenness did not occur even when the amount of the developer in the developing device 324 was large (375 to 400 g), wherefore use in a wide range of the amount of the developer is possible. In this way, it was confirmed that the occurrence of screw unevenness was effectively prevented even when the amount of the developer in the developing device 324 is large (375 to 400 g) as compared with Comparative Examples 1 and 2 by arranging the restricting plate 90 or 91.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A developing device, comprising:

a case for housing a developer;

a magnetic roller arranged in the case, the magnetic roller including a rotary shaft having opposite first and second axial ends spaced apart along an axial direction and configured to magnetically carry the developer on a circumferential surface by rotating about the rotary shaft;

an agitating member arranged to face the magnetic roller in the case, the agitating member including a shaft center extending parallel to the axial direction and a screw forming portion defining a spiral shape arranged around the shaft center, the spiral shape being configured to agitate the developer and to convey the developer toward the first axial end while rotating about the shaft center;

a layer thickness restricting member arranged to face the magnetic roller and configured to restrict the layer thickness of the developer supplied from the agitating member to the magnetic roller to a predetermined thickness; and a restricting plate arranged along the axial direction of the magnetic roller to face the circumferential surface of the magnetic roller at a side upstream of the layer thickness restricting member in a rotating direction of the magnetic roller, the restricting plate having a plurality of elongated projections configured to come into contact with the developer carried on the magnetic roller, each of the elongated projections extending in a first direction inclined with respect to a plane perpendicular to the axial direction of the magnetic roller so that developer that is not initially removed from the magnetic roller is conveyed in the first direction and mixes with the developer supplied to the magnetic roller from the agitating member.

2. A developing device according to claim 1 wherein:

the spiral shape is inclined toward the first axial end of the rotary shaft of the magnetic roller; and the elongated projections are inclined toward the second end of the rotary shaft of the magnetic roller.

3. A developing device according to claim 1, wherein:

an interval between the plurality of elongated projections in the axial direction of the magnetic roller is smaller than a pitch of the screw forming portion in an axial center direction of the agitating member.

4. A developing device according to claim 1, wherein:

the magnetic roller and the agitating member rotate in opposite direction; and the first direction is inclined in the same direction as a direction of conveying the developer by the screw forming portion with respect to an axial center direction of the agitating member.

5. A developing device according to claim 1, wherein:

the elongated projections are defined by a plurality of first grooves extending in the first direction on the restricting plate; and the restricting plate further having a plurality of second grooves extending in a direction intersecting the first direction.

6. A developing device according to claim 5, wherein:

an interval between the first grooves or the second grooves in a rotation axis direction of the magnetic roller is smaller than a pitch of the screw forming portion in an axial center direction of the agitating member.

7. An image forming apparatus, comprising:

a developing device according to claim 1; and an image bearing member on a surface of which an electrostatic latent image is to be formed and developed into a developer image by a developer supplied from the magnetic roller.

8. A developing device according to claim 1, wherein:

planes extending parallel to the first directions of the respective elongated projections and perpendicular to the restricting plate are inclined to the axial direction of the magnetic roller.

9. A developing device, comprising:

a case for housing a developer;

a magnetic roller arranged in the case, the magnetic roller including a rotary shaft having opposite first and second axial ends spaced apart along an axial direction and configured to magnetically carry the developer on a circumferential surface by rotating about the rotary shaft;

an agitating member arranged to face the magnetic roller in the case, the agitating member including a shaft center extending parallel to the axial direction and a screw forming portion defining a spiral shape arranged around the shaft center, the spiral shape being configured to agitate the developer and to convey the developer toward the first axial end while rotating about the shaft center;

a layer thickness restricting member arranged to face the magnetic roller and configured to restrict the layer thickness of the developer supplied from the agitating member to the magnetic roller to a predetermined thickness; and a restricting plate facing the circumferential surface of the magnetic roller at a side upstream of the layer thickness restricting member in a rotating direction of the magnetic roller, the restricting plate having a base aligned substantially parallel to the axial direction of the magnetic roller and a plurality of elongated projections projecting from the base toward the magnetic roller, each of the elongated projections extending longitudinally in a first direction aligned so that a plane parallel to the first direction and perpendicular to the base is inclined to the axial direction of the magnetic roller.

10. A developing device according to claim 9, wherein:

the elongated projections are defined by a plurality of grooves extending in the first direction on the restricting plate.

11. A developing device according to claim 10, wherein the grooves are configured and aligned so that developer that is not initially removed from the magnetic roller is conveyed in the first direction and mixes with the developer supplied to the magnetic roller from the agitating member.

* * * * *